US012410977B2

(12) United States Patent
Okenka

(10) Patent No.: US 12,410,977 B2
(45) Date of Patent: Sep. 9, 2025

(54) FIREARM

(71) Applicant: Ceska Zbrojovka a.s., Orech (CZ)

(72) Inventor: Martin Okenka, Orech (CZ)

(73) Assignee: Ceska Zbrojovka a.s., Uhersky Brod (CZ)

( * ) Notice: Subject to any disclaimer, the term of this patent is extended or adjusted under 35 U.S.C. 154(b) by 0 days.

(21) Appl. No.: 18/838,952

(22) PCT Filed: Feb. 2, 2023

(86) PCT No.: PCT/CZ2023/000004
§ 371 (c)(1),
(2) Date: Aug. 15, 2024

(87) PCT Pub. No.: WO2023/165641
PCT Pub. Date: Sep. 7, 2023

(65) Prior Publication Data

US 2025/0198714 A1 Jun. 19, 2025

(30) Foreign Application Priority Data

Mar. 3, 2022 (CZ) ..... CZ2022-98

(51) Int. Cl.
*F41A 3/46* (2006.01)
*F41A 3/86* (2006.01)

(52) U.S. Cl.
CPC . *F41A 3/46* (2013.01); *F41A 3/86* (2013.01)

(58) Field of Classification Search
CPC ..... F41A 3/36; F41A 3/38; F41A 3/40; F41A 3/44; F41A 3/46; F41A 5/02
See application file for complete search history.

(56) References Cited

U.S. PATENT DOCUMENTS 834,753 A * 10/1906 Reifgraber ..... F41A 3/38 89/159
3,213,558 A * 10/1965 Asker ..... F41A 3/46 42/17

(Continued)

FOREIGN PATENT DOCUMENTS

AT 510291 B1 * 3/2012 ..... F41A 3/44
DE 1124400 B 2/1962

(Continued)

OTHER PUBLICATIONS

PCT Search Report and Written Opinion dated May 10, 2023 for related PCT Patent Application No. PCT/CZ2023/000004, 8 pages.

*Primary Examiner* — Gabriel J. Klein
(74) *Attorney, Agent, or Firm* — Hovey Williams LLP; Paul J. Walker

(57) ABSTRACT

A firearm, comprising a frame (1) in which a breech block carrier (4) is arranged, as well as a barrel (2) behind the rear face (3) of which the breech block (5) is arranged in the frame (1). The barrel (2) is firmly connected to a barrel sleeve (6). The barrel sleeve (6) is slidingly mounted in a linear guide in the frame (1). The breech block (5) is mounted behind the rear face (3) of the barrel (2) slidingly in the direction of the barrel (2) axis. The breech block carrier (4) is slidingly mounted in a linear guide in the frame (1). On the top side of the breech block (5), a vertically movable locking block (9) is arranged, and the locking block (9) can be introduced into a recess (10) in the barrel sleeve (6). The frame (1) is provided with a front stop (12) of the barrel sleeve (6) and a rear stop (13) of the barrel sleeve (6). The barrel sleeve (6) is provided with a front stop (15) of the breech block (5), and a rear stop (16) of the breech block carrier (4). A barrel spring (14) is arranged between the frame (1) and the barrel sleeve (6).

11 Claims, 10 Drawing Sheets

(56) References Cited

U.S. PATENT DOCUMENTS

| | | | | | |
|---|---|---|---|---|---|
| 3,408,895 | A * | 11/1968 | Lopez | F41A 3/40 | 89/176 |
| 3,845,689 | A * | 11/1974 | Zanoni | F41A 3/40 | 89/181 |
| 4,461,203 | A | 7/1984 | Jawdat | | |
| 6,993,864 | B1 * | 2/2006 | O'Clair | F41A 5/04 | 42/71.02 |
| 10,731,933 | B2 * | 8/2020 | Streshinsky | F41A 5/02 | |
| 11,680,759 | B2 * | 6/2023 | Bandini | F41A 5/02 | 89/196 |
| 2007/0012170 | A1 * | 1/2007 | Spielberger | F41A 3/40 | 89/196 |
| 2014/0196337 | A1 * | 7/2014 | Bandini | F41A 5/02 | 42/16 |
| 2018/0066904 | A1 * | 3/2018 | Tuason | F41A 3/46 | |
| 2018/0306536 | A1 * | 10/2018 | Ellis | F41A 3/44 | |
| 2019/0128626 | A1 * | 5/2019 | Streshinsky | F41A 3/44 | |
| 2020/0200495 | A1 * | 6/2020 | Weilharter | F41A 5/12 | |
| 2024/0288236 | A1 * | 8/2024 | Weilharter | F41A 3/62 | |
| 2025/0172360 | A1 * | 5/2025 | Prinz | F41A 3/40 | |

FOREIGN PATENT DOCUMENTS

| | | | | |
|---|---|---|---|---|
| EP | 1344999 | A1 * | 9/2003 | F41A 3/46 |
| EP | 4242573 | A1 * | 9/2023 | F41A 3/38 |
| GB | 507861 | A | 6/1939 | |
| WO | WO-2004029534 | A2 * | 4/2004 | F41A 15/12 |
| WO | WO-2004029536 | A1 * | 4/2004 | F41A 19/13 |
| WO | WO-2005108900 | A1 * | 11/2005 | F41A 3/56 |
| WO | WO-2024258375 | A1 * | 12/2024 | F41A 3/38 |

* cited by examiner

FIREARM

RELATED APPLICATIONS

This application is the National Stage of International Patent Application No. PCT/CZ2023/000004, filed Feb. 2, 2023, which is hereby incorporated herein by reference in its entirety, and which claims priority to Czech Patent Application No. PV 2022-98, filed Mar. 3, 2022, which is also incorporated herein by reference in its entirety.

TECHNICAL FIELD

The invention relates to a firearm comprising a frame in which a breech block carrier is arranged, as well as a barrel behind the rear face of which the breech block is arranged within the frame.

BACKGROUND ART

At present, the recoil of the locked barrel caused by a shot impulse is one of the used methods of imparting energy to the repeating mechanism of the firearm, most frequently the breech block carrier, which, after the shot, with the imparted kinetic energy carries out all the activities necessary to execute the first part of the repeating cycle of the firearm, especially unlocking the chamber, extracting and ejecting the cartridge case and compressing the recoil spring that drives the repeating mechanism, most frequently with a force acting upon the breech block carrier, in the remaining part of the repeating cycle, when the repeating mechanism especially ensures feeding a new cartridge and closing and locking it in the cartridge chamber.

In the case of short firearms, a slight modification of the above-described principle is currently used wherein in the rest position, the barrel is firmly locked to the breech directly, or with the use of separate locking elements, e.g., a locking block. Due to the shot impulse, the breech and barrel assembly is accelerated backwards. After a short common recoil, due to a change of the position with respect to the frame by interaction with the frame, the barrel is unlocked from the breech and the breech can further recoil separately at the acquired speed. The unlocked breech during the recoil especially ensures extracting and ejecting the empty cartridge case and compressing the recoil spring. In the remaining part of the repeating cycle, the recoil spring pushes the breech forwards to feed a new cartridge and to close and lock it in the chamber.

An important and to a certain extent typical feature of mechanisms of short firearms with a short recoil of the barrel is an unchanging position of the barrel with respect to the frame after the disconnection of the breech. After a short recoil together with the breech and after unlocking of the breech from the barrel, the barrel is stopped by an impact onto the firearm frame and does not recoil any more. Stopping of the barrel by the firearm frame results in a relative speed between the barrel and the breech and causes opening of the chamber. During the rest of the repeating cycle, the barrel remains in the recoiled position until the moment the breech starts to carry it forwards to the rest position, and during the common part of the forward movement, the barrel is locked to the breech.

The above-mentioned general principle of repeating mechanisms with barrel recoil intentionally omits operation of the trigger and striking mechanisms and other peripherals by the repeating mechanism to simplify the description.

To work with sufficient reliability, the described repeating mechanism often works with excess energy manifested especially in that the breech block carrier (or the breech of short firearms) still has a considerable speed at which it hits the firearm frame after the compression of the recoil spring and reaching the rear stop. In the case of powerful calibres or compact sizes of pistols, the energy of the mechanism is also excessive due to the weight restrictions imposed on handheld arms. This is manifested by a short, but very intensive force impulse into the shooter's grip. A negative consequence of the excess of energy in the mechanism is not only a worsened perception of the recoil by the shooter and the related worse shooting results, especially in dynamic situations, but also an increased stress of the parts of the repeating mechanism and the firearm frame, A possible use of spring buffers or buffers of elastic materials only brings a slight improvement.

It is the object of the invention to provide such a firearm that would not have the above-mentioned shortcomings of the prior art.

SUMMARY OF THE INVENTION

The said object is achieved through a firearm comprising a frame in which a breech block carrier is arranged, as well as a barrel behind the rear face of which the breech block is arranged in the frame, according to the invention the principle of which is that the barrel is firmly connected to a barrel sleeve. The barrel sleeve is slidingly mounted in a linear guide in the frame. The breech block is mounted behind the rear face of the barrel slidingly in the direction of the barrel axis. The breech block carrier is slidingly mounted in a linear guide in the frame. On the top side of the breech block, a vertically movable locking block is arranged, and the locking block can be introduced into a recess in the barrel sleeve. The frame is provided with a front stop of the barrel sleeve and a rear stop of the barrel sleeve. The barrel sleeve is provided with a front stop of the breech block, and a rear stop of the breech block carrier. A barrel spring is arranged between the frame and the barrel sleeve.

In a preferred embodiment, the breech block carrier is provided with a cutaway for positioning of the barrel sleeve and its relative movement with respect to the breech block carrier.

In another preferred embodiment, the cutaway is arranged on the breech block carrier substantially over the entire length of the breech block carrier.

In preferred embodiments, the recoil spring can be arranged between the barrel sleeve and the breech block carrier or between the frame and the breech block carrier.

In another preferred embodiment, the front stop of the barrel sleeve consists of a disassembly catch, mounted in the frame.

In another preferred embodiment, the firing pin of a hammer-type striking mechanism passes through the breech block carrier.

In another preferred embodiment, the barrel sleeve and the breech block carrier are slidingly mounted in a common linear guide in the frame.

In a preferred embodiment, the barrel sleeve forms a sights rail that carries iron or optoelectronic sights.

In another preferred embodiment, the locking block has control pins that are movably mounted in the control track of the breech block carrier.

In another preferred embodiment, the locking block forms a fixed part of the breech block and is vertically movable together with the breech block.

The solution according to the invention brings the following advantages:

The recoiling masses are bigger in spite of a lower total weight of the gun, so according to the momentum conservation law, the energy transferred to the mechanism is lower.

The long recoiling masses internally impact to the barrel sleeve instead of to the frame. Thus, energy is transferred to the frame during two compressions of the barrel spring, and not during the impact of the barrel onto the frame and breech onto the frame.

In practice, no impact of the breech block carrier onto the frame normally occurs at all.

In a pistol with a steel frame and a plastic grip handle, the centre of mass of the non-moving part of the gun is situated very frontally and high, i.e., closer to the centre of mass of the recoiling masses, and their impact thus causes a lower torque raising the barrel upwards.

The sights only recoil linearly and very shortly, not leaving the focal plane maintained by the shooter.

The combination of a plastic grip handle and a steel frame combines the advantages of both of them—the steel frame provides a sufficient weight for impact filtering, service life and accuracy. The plastic grip handle with its compliance further absorbs impacts to the grip and enables user selection by ergonomic preferences.

The division of the function of the breech between the breech block carrier and the breech block makes it possible to use a very strong barrel spring that the user need not compress during manual handling of the carrier.

Separation of the carrier from the breech block at the moment of unlocking makes initiating of the cartridge primer impossible before the firearm is completely locked.

Forward acceleration of the long recoiling masses and the short recoiling assess by the rigid barrel spring shortens the times of the repeating cycle even without the use of a heavy recoil spring.

An exposed barrel sleeve supports installation of optoelectronic sights directly connected to the barrel.

Since the barrel is produced without a control surfaces, it can be produced from a forging of a considerably smaller diameter, which makes the production faster and cheaper, the quality of forging of the semi-finished product being better.

BRIEF DESCRIPTION OF DRAWINGS

The invention will be described in more detail using a particular embodiment example where the firearm is a pistol wherein in the accompanying drawings, individual figures show.

EXAMPLES OF EMBODIMENTS

Figure 1:
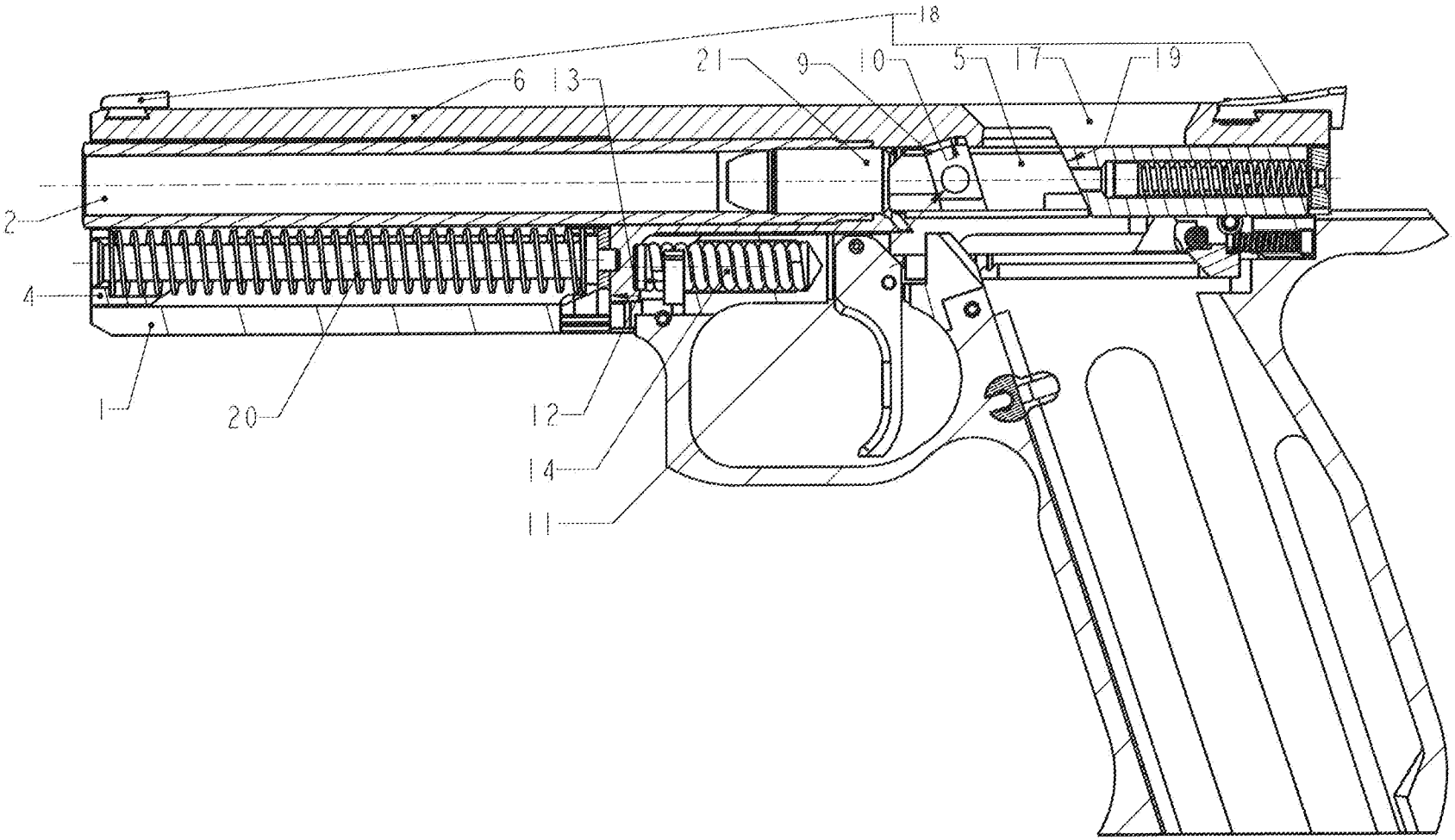
FIG. 1—a longitudinal section of the pistol in a view from the left in the shooting direction FIG. 2—a partial section of the pistol in a view nearly from the right in the shooting direction FIG. 3—a partial longitudinal section of the pistol in a view from the left in the shooting direction FIG. 4—a view of the pistol partly from the top, the front part of the barrel, breech block carrier and the barrel sleeve being shown in a sectional view, uncovering the guiding grooves in the frame FIG. 5—the firearm at the moment of reaching the short recoil FIG. 6—the firearm at the moment of unlocking the chamber FIG. 7—the firearm at the beginning of opening the chamber and extracting the cartridge case FIG. 8—a longitudinal section of the frame, showing the contact of the breech block carrier with the rear stop of the breech block carrier on the barrel sleeve FIG. 9—a longitudinal section of the frame, showing the short recoiling masses nearly in contact with the rear stop of the barrel sleeve and with the breech block carrier still bearing on the breech buffer FIG. 10—a detail of a slight recoil of the short recoiling masses after the impact of the long recoiling masses
Figure 2:
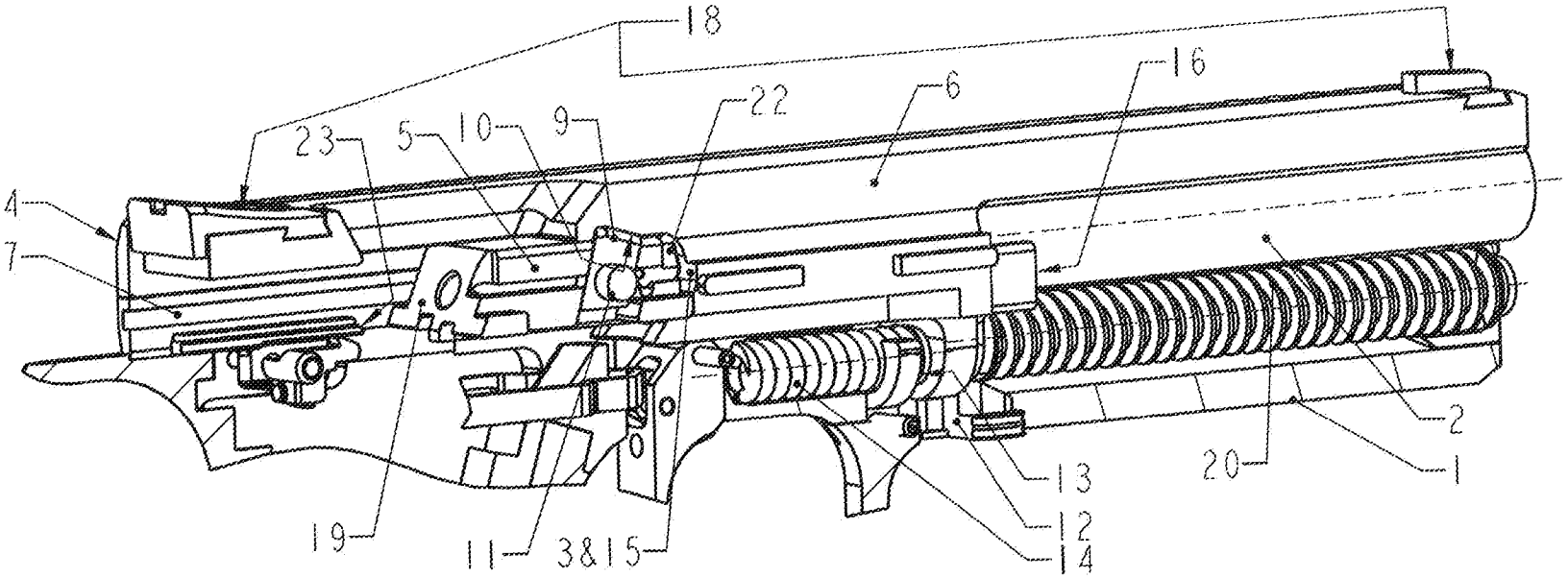
Figure 3:
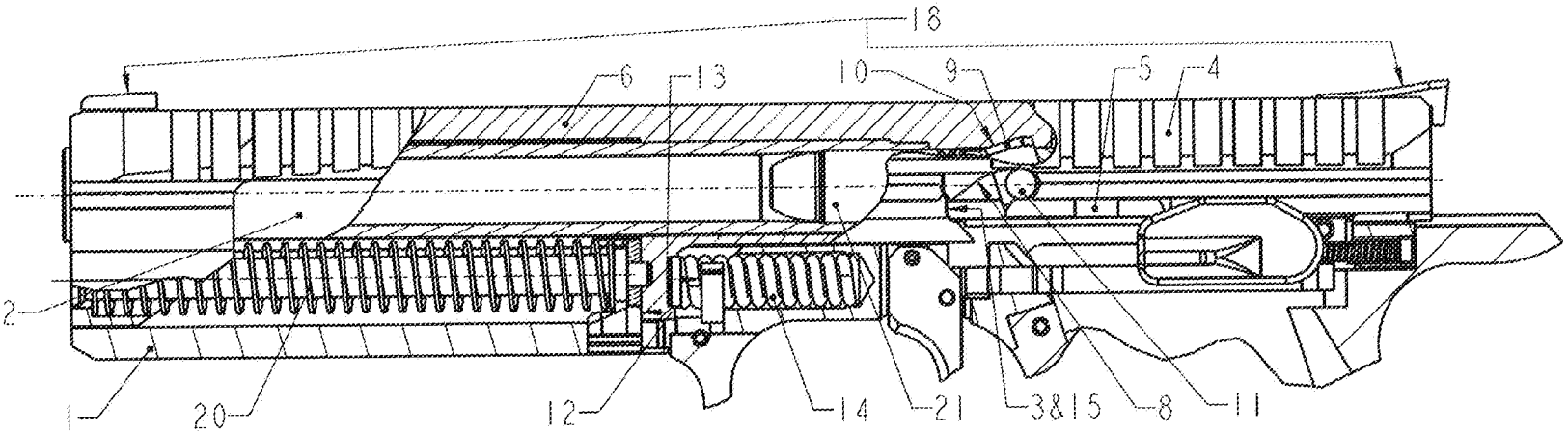
Figure 4:
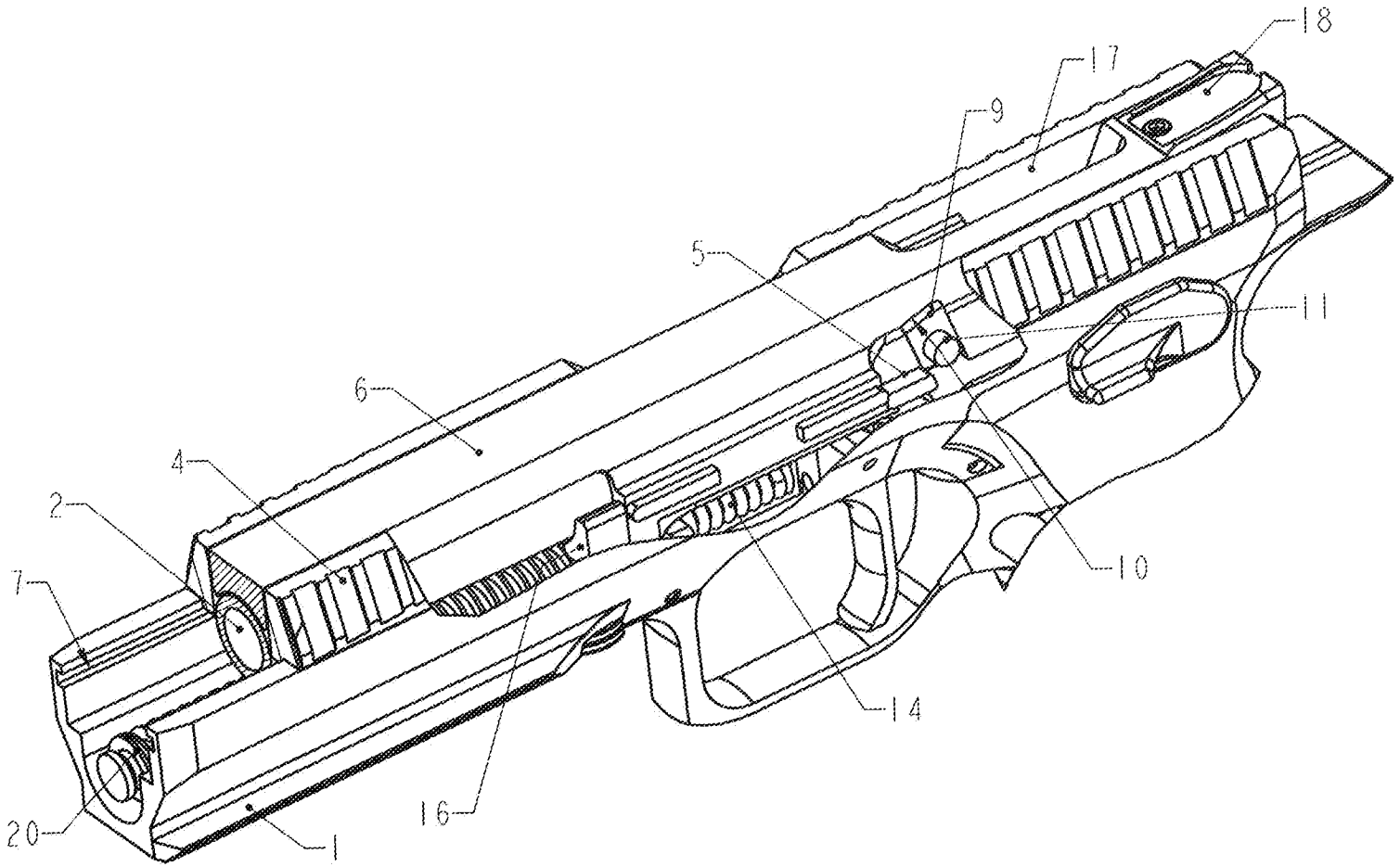

In the described embodiment example, the firearm is a pistol, but the inventive solution can also be applied to long firearms. The pistol comprises a frame 1 in the linear guide 7 of which a barrel sleeve 6 carrying the barrel 2 and sights 18 is movably mounted. The barrel 2 is firmly fixed to the barrel sleeve 6 (see FIGS. 1, 2, 3 and 4).

The frame 1 is made of steel and the grip handle is made of plastic.

A barrel spring 14 is arranged between the frame 1 and the barrel sleeve 6. A recoil spring 20 is arranged between the barrel sleeve 6 and the breech block carrier 4, or in an alternative embodiment, between the frame and the breech block carrier.

The breech block carrier 4 is also slidingly mounted in the same linear guide 7 as the barrel sleeve 6 in the frame. The breech block 5 is slidingly mounted behind the rear face 3 of the barrel 2 in the direction of the axis of the barrel 2.

The barrel sleeve 6 and the breech block carrier 4 do not have to be mounted in the frame 1 in the same linear guide 7, but the barrel sleeve 6 may have its own linear guide in the frame 1 and the breech block carrier 4 may have its own linear guide as well.

On the top side of the breech block 5, a vertically movable locking block 9 is arranged that can be introduced into a recess 10 in the barrel sleeve 6 by the action of the control track 8 on the breech block carrier 4. Control pins 11 of the locking block 9 are movably mounted in the control track 8 of the breech block carrier 4.

According to an embodiment that is not shown here, the locking block 9 forms an integral part of the breech block 5 and is vertically movable together with the breech block 5. The vertical movement is achieved with a tilting breech block 5.

The frame 1 is provided with a front stop 12 of the barrel sleeve 6 and a rear stop 13 of the barrel sleeve.

The barrel sleeve 6 is provided with a front stop 15 of the breech block 5 that is, in a preferred embodiment, formed by the rear face 3 of the barrel and the rear stop 16 of the breech block carrier 4.

The barrel sleeve 6 of the shown pistol forms a sights rail that carries iron sights. In an embodiment not shown here, there may be optoelectronic sights.

Sights of any kind may also be positioned on a special carrier connected to the frame 1 or the breech block carrier 4.

The breech block carrier 4 is provided with a cutaway 17 for positioning the barrel 6 sleeve and its relative movement with respect to the breech block carrier 4. The cutaway 17 may be arranged on the breech block carrier 4 on its top side virtually over the entire length of the breech block carrier 4, According to an embodiment not shown here, the breech block 5 is laterally guided on the inner surfaces of the cutaway 17 for the barrel sleeve 6.

According to another not shown embodiment, the firing pin of a hammer-type striking mechanism passes through the breech block carrier 4 and the breech block 5.

Locking is accomplished by raising the locking block 9 on the breech block 5 to the recess 10 in the barrel sleeve 6, which will result in a mechanical connection of the assembly unit of the barrel 2—barrel sleeve 6—locking block 9—breech block 5.

The movement of the locking block 9 during the closing and locking of the mechanism as well as during its unlocking and opening is controlled by the control track 8 arranged on the side plates of the breech block carrier 4.

In the rest condition, the barrel sleeve 6 with the barrel 2 is pushed by the barrel spring 14 to the disassembly catch acting as the front stop 12 of the barrel sleeve in the frame 1. The breech block 5, which bears on the front stop 15 of the breech block on the barrel sleeve 6, is in contact with the barrel sleeve 6. The breech block carrier 4, which is pushed forwards by the recoil spring 20, bears on the front stop 19 of the breech block carrier on the breech block 5. The carried locking block 9 is pushed into the recess 10 in the barrel sleeve 6, causing the breech block 5 to be firmly locked to the barrel sleeve 6.

In the following description, parts that perform a long recoil, i.e., the assembly comprising the breech block carrier 4, breech block 5, locking block 9, including parts of the extracting and striking mechanisms, will be referred to as "long recoiling masses".

Also, in the further description, parts performing a short recoil, i.e., the assembly comprising the barrel sleeve 6 with the barrel 2 and sights 18, and possible other masses firmly connected to the barrel sleeve 6, will be referred to as "short recoiling masses".

Figure 5:
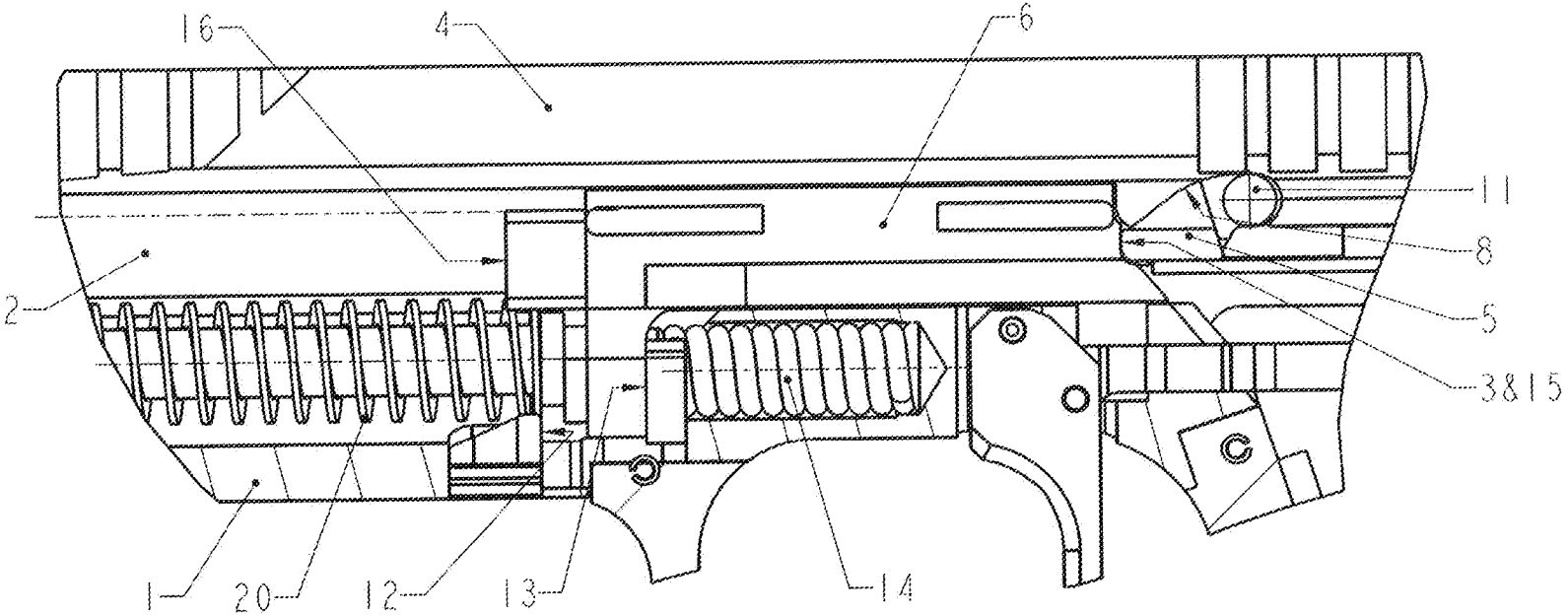

The cartridge is initiated in any manner and the pressure of the produced gasses propels the projectile forwards through the barrel. The pressure acts upon the cartridge case 21 bottom and the resulting force acts upon the breech block 5 rearwards. The breach block 5 is carried rearwards, and due to its locking to the barrel sleeve 6 and contact with the breech block carrier 4, it carries the barrel sleeve 6 with the barrel 2 and the breech block carrier 4 with it against the force of the barrel spring 14 until the moment of the contact of the barrel sleeve 6 with the frame 1. The position of the breech block carrier 4 with respect to the barrel sleeve 6 does not change until the moment of deceleration of the barrel sleeve 6 by the frame 1 and the firearm remains completely locked during the time of the short recoil. The position of reaching the short recoil is shown in FIG. 5. The short recoil refers to the length of movement executed by the barrel sleeve 6 from its rest position in contact with the front stop 12 to its fully recoiled position in contact with its rear stop 13. In FIG. 5, the frame is shown in a longitudinal section in a view from the left in the shooting direction, and the detail is focused on the central part of the firearm. The contact of the barrel sleeve 6 with the barrel buffer forming the rear stop 13 of the barrel sleeve is clearly seen here. The disassembly catch forming the front stop 12 of the barrel sleeve is relieved and the control pins 11 of the locking block 9 are at the top end of the control track 8.

The impact of the barrel sleeve 6 on the barrel stop, which is in this case formed by the rear stop 13 of the barrel sleeve, stops the movement of the barrel sleeve 6 with the barrel 2 and the breech block 5 locked to it with respect to the frame 1. The breech block carrier 4 continues moving rearwards at the acquired speed and gradually decelerates due to the compression of the recoil spring 20.

In the described embodiment, the stops are provided with buffers that are made of elastic materials and are used to extend the service life of the mechanism without principally changing its function.

Figure 6:
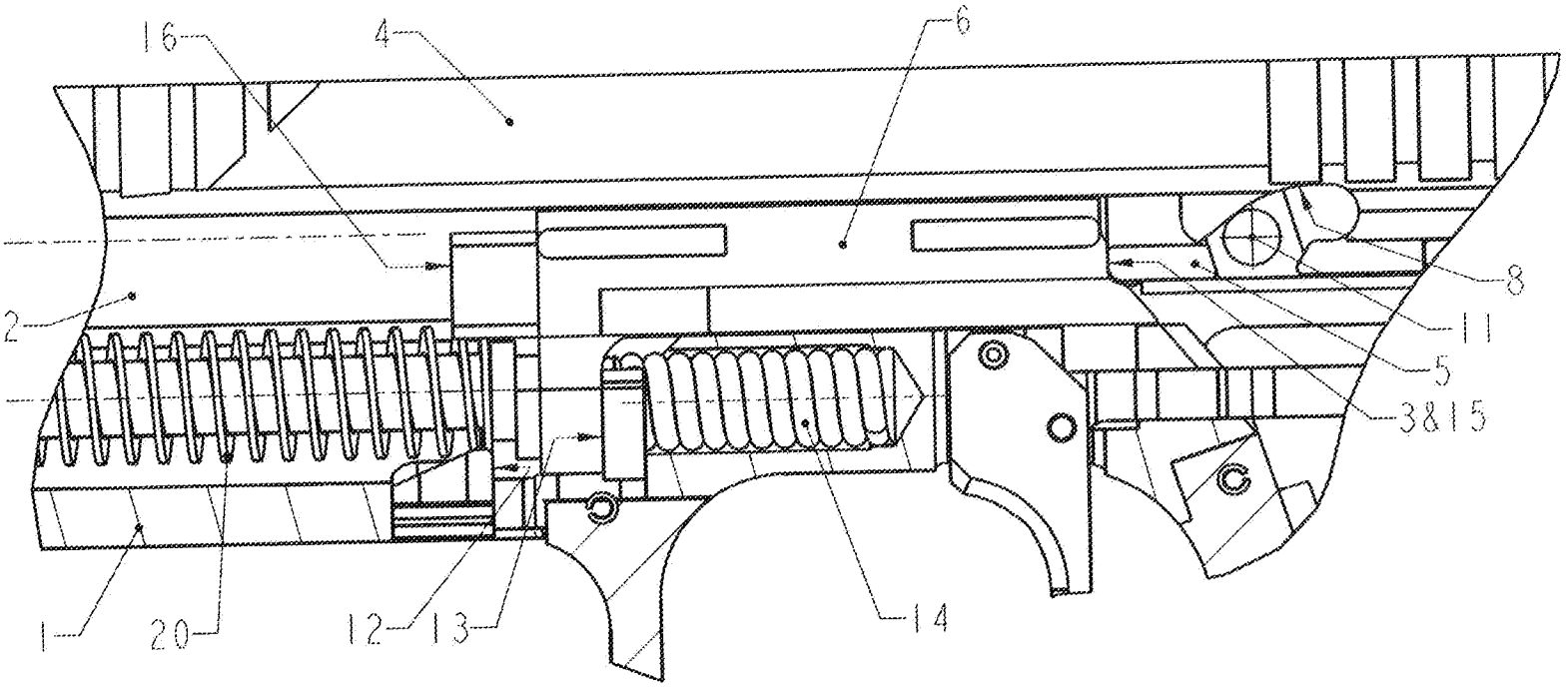

The relative rearward movement of the breech block carrier 4 with respect to the breech block 5 causes, due to the contact of the control track 8 on the breech block carrier 4 and the control pins 11 on the carried locking block 9, removal of the locking block 9 from the recess 10 in the barrel sleeve 6 and mechanical disconnection of the breech block 5 and the barrel sleeve 6. The firearm remains locked until the completion of the recoil of the breech block carrier 4 by the sum of lengths of the short recoil and the active length of the control track 8. In FIG. 6, the mechanism is shown in the condition with the barrel sleeve 6 in the rear recoiled position in contact with the rear stop 13 of the barrel sleeve (barrel buffer) and with the breech block carrier 4 recoiled also by the active length of the control track 8 further, I.e., at the moment of unlocking the chamber. The frame 1 is shown in a longitudinal section in a view from the left in the shooting direction, and the detail is focused on the central part of the firearm. The contact of the barrel sleeve 6 and the barrel buffer forming the rear stop 13 of the barrel sleeve can be clearly seen. The disassembly catch, forming the front stop 12 of the barrel sleeve is relieved and the control pins 11 of the locking block 9 are at the bottom end of the control track 8.

At the moment of complete lowering of the carried locking block 9, the breech block carrier 4 and the breech block 5 get in contact on the carrying surfaces and the breech block carrier carries the breech block 5 with the locking block 9 rearwards with its inertia.

Disconnection of the barrel sleeve 6 and the breech block 5 makes it possible for the barrel sleeve 6 with the barrel 2 to move forwards by the action of the compressed barrel spring 14 to the rest condition to the front stop of the barrel sleeve 6, which is, in the embodiment example, formed by the disassembly catch.

Figure 7:
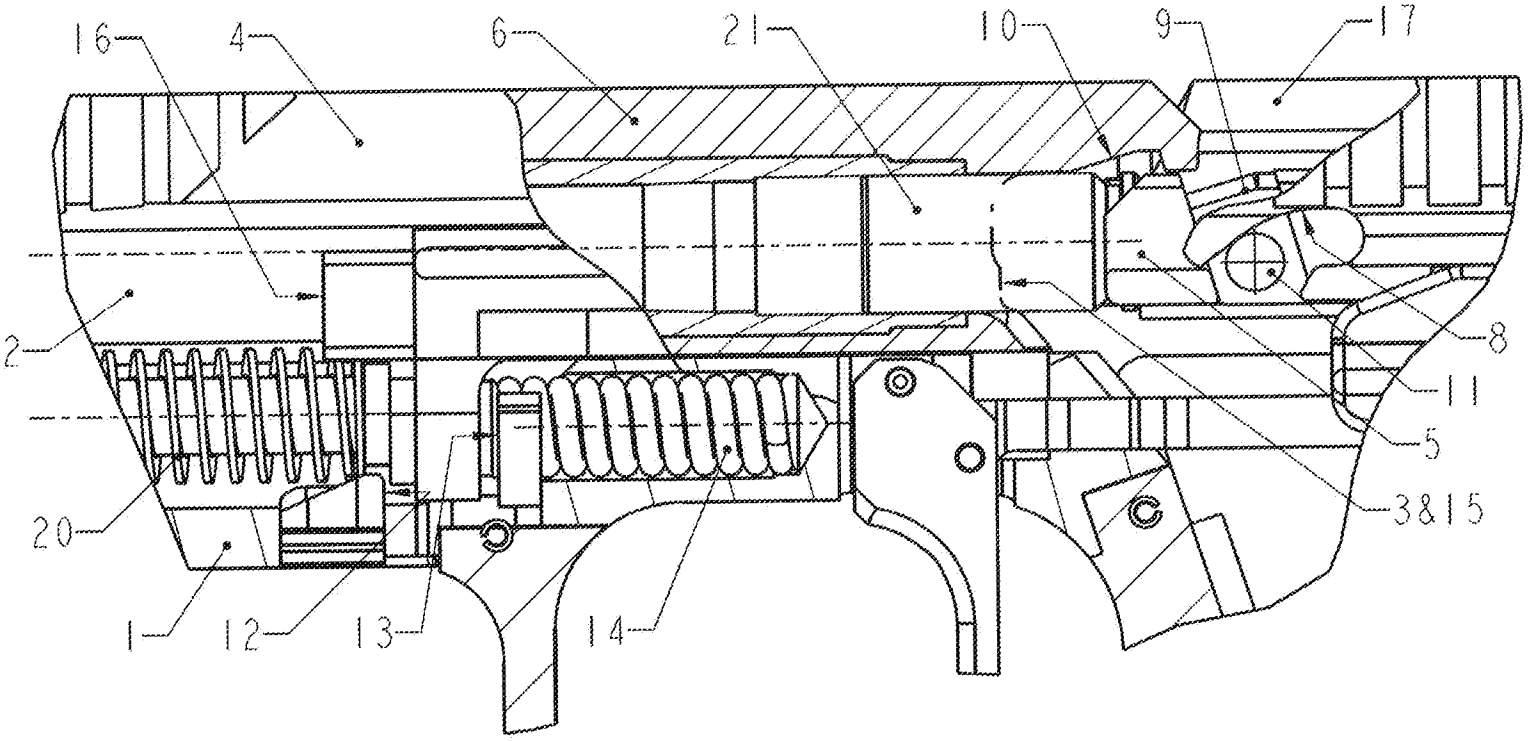

The continuing rearward movement of the long recoiling masses and forward movement of the short recoiling masses opens the chamber. The breech block 5 with the extractor 22 extracts the empty cartridge 21 case and carries it backwards until the cartridge case 21 is ejected by the ejector 23 out of the firearm mechanism. In FIG. 7, the mechanism is shown at the beginning of opening the chamber and extracting the cartridge case 21 wherein the frame 1 is shown in a longitudinal section in a view from the left in the shooting direction, and the detail is focused on the central part of the firearm. The breech block carrier 4 is shown in a partial longitudinal section. The barrel sleeve 6 is shown as being pushed away from the rear stop 13 of the barrel sleeve by the barrel spring 14 and the breech block 5 is detached from the front stop 15 of the breech block, which is indicated with a dashed line behind the cartridge case 21.

At the moment of the full recoil of the long recoiling masses with respect to the short recoiling masses, the barrel sleeve 6 with the barrel 2 is already completely pushed by the barrel spring 14 to its rest condition in contact with the front stop 12 of the barrel sleeve (disassembly catch), or it is at least detached from the rear stop 13 of the barrel sleeve and has a forward speed with respect to the frame 1 imparted by the barrel spring 14. The long recoiling masses lose their speed by their impact onto the short recoiling masses. The short recoiling masses take over a part of the rearwards momentum of the long recoiling masses and there is the second recoil of the short recoiling masses during a single functional cycle of the firearm.

Figure 8:
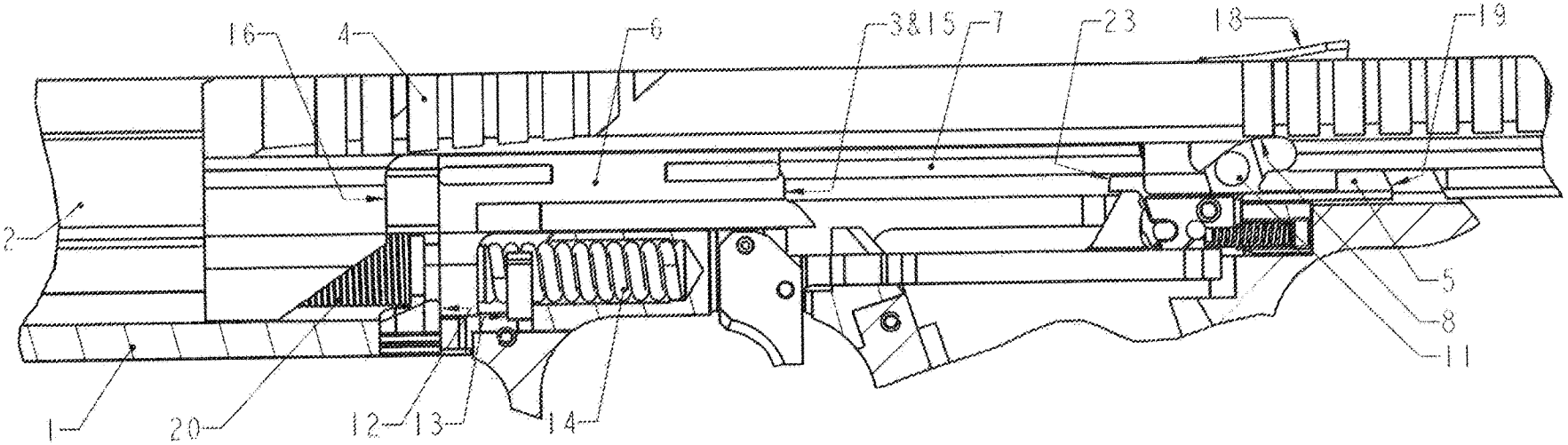

In FIG. 8, the mechanism is shown at the moment of the impact of the long recoiling masses (at their rear recoiled position) onto the short recoiling masses (at their front rest position) wherein the frame 1 is shown in a longitudinal section. It clearly shows the contact of the breech block carrier 4 with the rear stop 16 of the breech block carrier 4 on the barrel sleeve 6 (formed by the breech buffer), which is shown at its front rest position in contact with the front stop 12 of the barrel sleeve.

The short force impulse that would otherwise be transferred onto the frame 1 at the moment when the long recoiling masses reach the rear recoiled position, is thus distributed by the effect of the mass of the barrel sleeve 6 with the barrel 2 and by the action of barrel spring 14 into a long force impulse with lower maximum values. However, in practice, there is no impact of the breech block carrier 4 onto the frame 1 at all.

Figure 9:
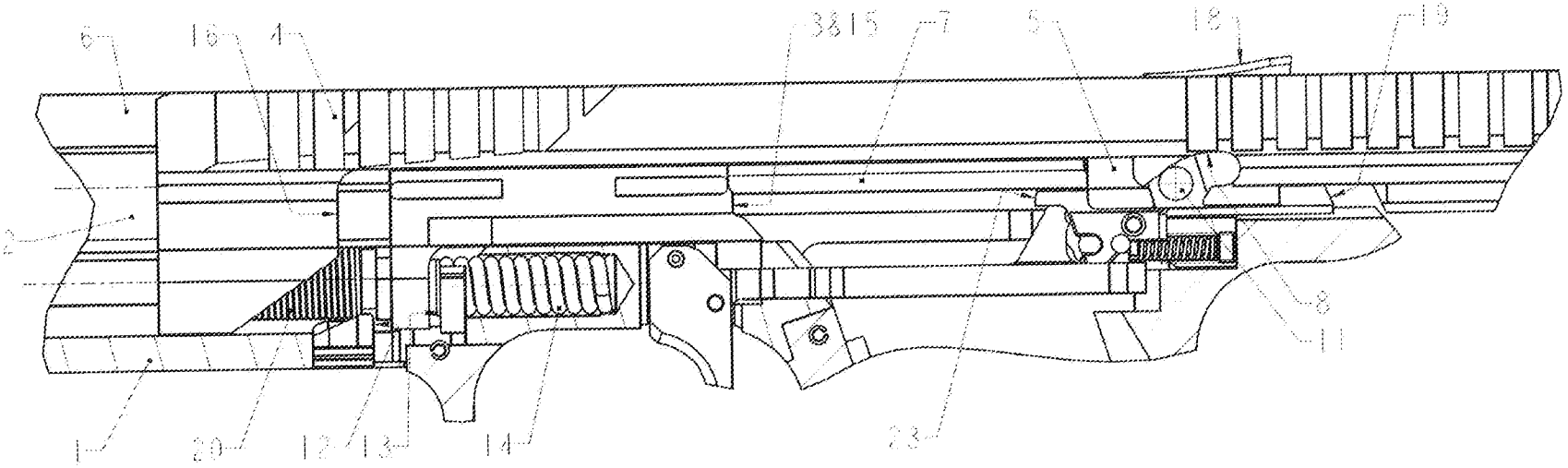

FIG. 9 shows the mechanism in the state of the second recoil of the short recoiling masses to their rear recoiled position (almost in contact with the rear stop 13 of the barrel sleeve) with the breech block carrier 4 still bearing on the breech buffer wherein the frame 1 is shown in a longitudinal section.

Figure 10:
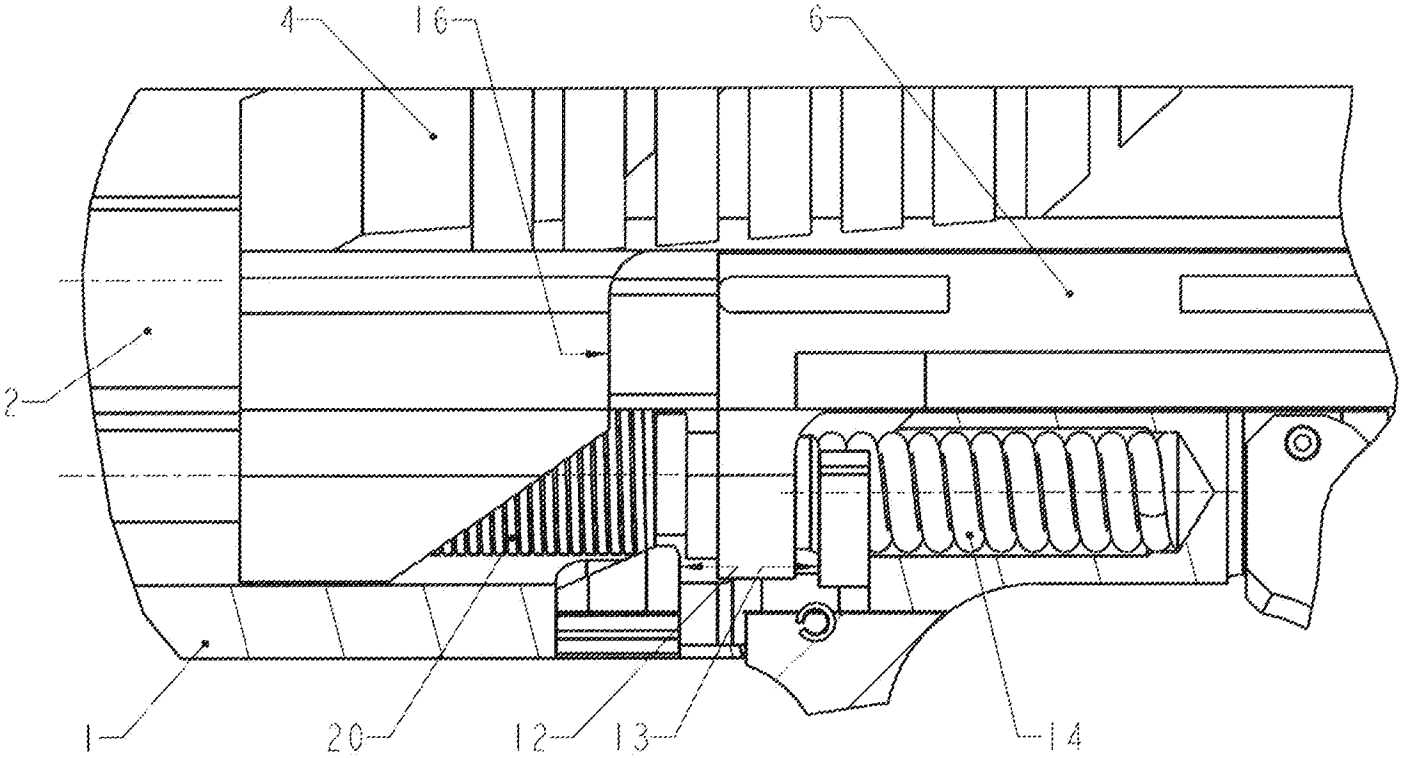

FIG. 10 shows the detail of a slight recoil of the short recoiling masses after the impact of the long recoiling masses. The contact of the breech block carrier 4 via the breech buffer forming the rear stop 16 of the breech block carrier with the barrel sleeve 6 is visible here. The barrel sleeve 6 is at the end of the second recoil, nearly in contact with the rear stop 13 of the barrel sleeve.

After the collision of the long recoiling masses at the rear recoiled position with the short recoiling masses, all these masses are decelerated and stopped by the action of the barrel spring 14, and subsequently accelerated forwards. The action of the rigid barrel spring 14, exerting great forces not only upon the barrel sleeve 6 with the barrel 2, but also upon the long recoiling masses causes considerable forward acceleration of the long recoiling masses right at the beginning of their forward movement, which makes it possible to advantageously select a weaker recoil spring 20 to provide easy control by the shooter while maintaining a short functional cycle enabling quick continuous shooting.

After the short recoiling masses are completely pushed to their rest position in contact with the disassembly catch, the long recoiling masses continue their forward movement, being pushed forwards with the recoil spring 20. A new cartridge is fed and the breech block 5 is stopped by the front stop 15 of the breech block, formed on the barrel sleeve 6. The breech block carrier 4 continues moving forwards and with its control track 8 it raises the locking block 9 into the recess 10 in the barrel sleeve 6. At the moment of the impact of the breech block carrier 4 onto the rear end of the breech block 5, the locking block 9 is fully extended and the breech block 5 is locked to the barrel sleeve 6.

INDUSTRIAL APPLICABILITY

The proposed firearm mechanism is applicable to short as well as long firearms, but advantageously to firearms of powerful calibres or compact or lightweight firearms, or possibly sports firearms, the rigidity and weight of the structure always being adapted to the requirements of the particular firearm segment.

LIST OF REFERENCE SIGNS

1 frame
2 barrel
3 rear face of the barrel
4 breech block carrier
5 breech block
6 barrel sleeve
7 linear guide
8 control track of the breech block carrier
9 locking block
10 recess
11 control pin of the locking block
12 front stop of the barrel sleeve
13 rear stop of the barrel sleeve
14 barrel spring
15 front stop of the breech block
16 rear stop of the breech block carrier
17 cutaway
18 sights
19 front stop of the breech block carrier
20 recoil spring
21 cartridge case
22 extractor
23 ejector

The invention claimed is:

1. A firearm, comprising a frame (1) in which a breech block carrier (4) is arranged, as well as a barrel (2) having a rear face (3) behind which a breech block (5) is arranged in the frame (1), characterized in that the barrel (2) is firmly connected to a barrel sleeve (6), and the barrel sleeve (6) is slidingly mounted in a linear guide in the frame (1), wherein the breech block (5) is mounted behind the rear face (3) of the barrel (2) slidingly in a direction of a barrel (2) axis, and the breech block carrier (4) is slidingly mounted in a linear guide in the frame (1)

wherein on a top side of the breech block (5), a vertically movable locking block (9) is arranged, and the locking block (9) can be introduced into a recess (10) in the barrel sleeve (6), wherein the frame (1) is provided with a front stop (12) for the barrel sleeve (6), and a rear stop (13) for the barrel sleeve (6), and the barrel sleeve (6) is provided with a front stop (15) for the breech block (5), and a rear stop (16) for the breech block carrier (4), wherein a barrel spring (14) is arranged between the frame (1) and the barrel sleeve (6).

2. The firearm according to claim 1, characterized in that the breech block carrier (4) is provided with a cutaway (17) for positioning the barrel sleeve (6) and its relative movement with respect to the breech block carrier (4).

3. The firearm according to claim 2, characterized in that the cutaway (17) is arranged on the breech block carrier (4) on its top side, substantially over an entire length of the breech block carrier (4).

4. The firearm according to claim 1, characterized in that a recoil spring (20) is arranged between the barrel sleeve (6) and the breech block carrier (4).

5. The firearm according to claim 1, characterized in that a recoil spring (20) is arranged between the frame (1) and the breech block carrier (4).

6. The firearm according to claim 1, characterized in that the front stop (12) of the barrel sleeve is formed by a disassembly catch that is mounted in the frame (1).

7. The firearm according to claim 1, characterized in that a firing pin of a striking mechanism passes through the breech block carrier (4) and the breech block (5).

8. The firearm according to claim 1, characterized in that the barrel sleeve (6) and the breech block carrier (4) are slidingly mounted in a common linear guide (7) in the frame (1).

9. The firearm according to claim 1, characterized in that the barrel sleeve (6) forms a sight rail that carries iron or optoelectronic sights.

10. The firearm according to claim 1, characterized in that the locking block (9) has control pins (11) that are movably mounted in a control track (8) of the breech block carrier (4).

11. The firearm according to claim 1, characterized in that the locking block (9) forms an integral part of the breech block (5) and is vertically movable together with the breech block (5).

* * * * *